United States Patent [19]

Rado et al.

[11] Patent Number: 4,574,259

[45] Date of Patent: Mar. 4, 1986

[54] HIGH SWITCHING SPEED ELECTRICALLY TUNED MICROWAVE MAGNETIC RESONANCE DEVICES

[75] Inventors: George T. Rado, McLean, Va.; Carmine Vittoria, Bowie, Md.; James M. Ferrari, Springfield, Va.

[73] Assignee: The United States of America as represented by the Secretary of the Navy, Washington, D.C.

[21] Appl. No.: 684,207

[22] Filed: Dec. 20, 1984

[51] Int. Cl.[4] ..... H01P 1/19

[52] U.S. Cl. ..... 333/157; 333/158; 333/231; 333/248

[58] Field of Search ..... 333/157–158, 333/24.1, 231, 24.2, 239, 248; 343/754, 756, 768, 778, 787

[56] References Cited

U.S. PATENT DOCUMENTS

| | | | |
|---|---|---|---|
| 2,905,940 | 9/1959 | Spencer et al. | 343/768 |
| 2,946,056 | 7/1960 | Shanks | 343/768 |
| 2,994,874 | 8/1961 | Kihn | 343/768 |
| 3,069,680 | 12/1962 | Seeley et al. | 333/158 X |
| 3,398,382 | 8/1968 | Jones et al. | 333/24.1 X |
| 4,353,042 | 10/1982 | D'Oro et al. | 333/158 X |
| 4,506,234 | 3/1985 | Vittoria | 333/158 X |

OTHER PUBLICATIONS

Kumar—"Fine Tuning of Microwave Ferrite Circulators and Isolators," Electro-Technology (India), Jan.-Feb. 1971; pp. 23–24.

G. Wheeler et al.—"Temperature Compensation of Ferrite Isolators", The Microwave Journal, Feb. 1959; pp. 31–32.

*Primary Examiner*—Marvin L. Nussbaum

*Attorney, Agent, or Firm*—Robert F. Beers; William T. Ellis; Ansel M. Schwartz

[57] ABSTRACT

An apparatus for changing the phase of a microwave signal comprising:

a sample that exhibits the magneto-electric effect;

a metal enclosure loaded with said sample; a voltage source; a feed electrode and a ground electrode attached to said sample and to said voltage source so that a voltage difference is created across said sample by said voltage source, said feed electrode connecting said voltage source and said sample by passing through said; a coupling slot in said enclosure that enables microwaves to enter into said enclosure and leave said enclosure after the microwave has been phase shifted and a means for producing a magnetic field inside the metal enclosure.

14 Claims, 3 Drawing Figures

HIGH SWITCHING SPEED ELECTRICALLY TUNED MICROWAVE MAGNETIC RESONANCE DEVICES

BACKGROUND OF THE INVENTION

The present invention relates to a high speed tunable microwave cavity. More specifically the present invention relates to a microwave cavity loaded with a ferrite which exhibits the magneto-electric effect and that has a voltage applied across the ferrite which determines the resonance frequency of the cavity.

Microwave beam shifting was originally produced by mechanical systems, or by a system of manifolding to distribute microwave energy to individual waveguide elements, where each element contains a phase shifter followed by an antenna transmitter. In the manifolded system, beam shifting is accomplished by applying electric currents to the phase shifters. The mechanical method of beam shifting is slow and readily subject to wear and malfunction. The manifolded method of beam shifting requires a considerable amount of space to accomplish power distribution and each consecutive phase shifter must shift a greater amount to maintain proper beam proportion, since phase shift is not additive or reciprocal. An improved version was devised in U.S. Pat. No. 3,069,680 with the cavities being tuned by changing a magnetic field. In U.S. Pat. No. 3,069,680, the beam shifting system used ferrite-loaded solenoid-wound cylindrical cavities coupled with a slot array waveguide. The use of ferrite-loaded phase shift cavities induces phase shift into a waveguide containing a slot array and causes the beam lean angle to change. The phase shift is varied by changing the D.C. current in the solenoid coil around the cavity. Since the permeability of the ferrite is varying with current drive, the phase shift of the microwave signal propagating in the waveguide is also varied. The microwave cavity is coupled electromagnetically to the waveguide. The tuning speed is limited by the time constant of the solenoid coil, which is given as $$\tau = L/R$$

where L and R are the inductance and resistance of the coil wrapped around the cavity. Typically, L=0.1 mh and R=1 ohm. This means that the tuning speed of the cavities used in U.S. Pat. No. 3,069,680 is of the order of 0.1 msec.

A problem associated with the use of magnetic materials in modulating microwave signals is that the magnetic properties of the materials change with temperature. In microwave devices where the ferromagnetic resonant frequency of a magnetic material is required to be stable, temperature fluctuations are inadvertently introduced into such systems. These temperatures fluctuations may give rise to undesireable modulation effects of a microwave signal.

Additionally, where the ferromagnetic resonance is required to be tuned, the tuning is achieved by changing a magnetic field provided by a magnetic field generating device, e.g., a helmholtz coil. Typically a helmholtz coil with a 1 ohm resistance and a 1 inch diameter requires about 10–100 $\mu$ watts to generate a given amount of tuning. If there is more than one ferrite device, the high wattage consumption is undesireable.

SUMMARY OF THE INVENTION

Accordingly, one object of this invention is to provide a novel high speed tunable microwave cavity.

Another object of the present invention is to provide a novel high speed accurately tunable microwave cavity.

Another object of the present invention is to provide a novel highly accurate high speed tunable microwave cavity in which the power consumption required for tuning is low.

Another object of the present invention is to provide a novel high speed tunable microwave cavity that is easily temperature compensated.

Another object of the present invention is to produce a shift of the ferromagnetic resonance in a ferrite material that exhibits magneto-electric properties by varying a DC voltage that is placed on the ferrite material.

These and other objects are attained with an apparatus for changing the phase of a microwave signal comprising: a means for producing a biasing static magnetic field; a sample that exhibits the magneto-electric effect; means for supporting the sample in the magnetic field produced by said magnetic field producing means; means for applying a voltage difference across said sample so that a voltage difference will lie across said sample, and means for coupling the microwave signal to said sample so that said sample will reflect the microwave signal with a phase shift through said coupling means, the phase shift of the reflected microwave signal being determined by the biasing magnetic field and by the voltage applied across the sample.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
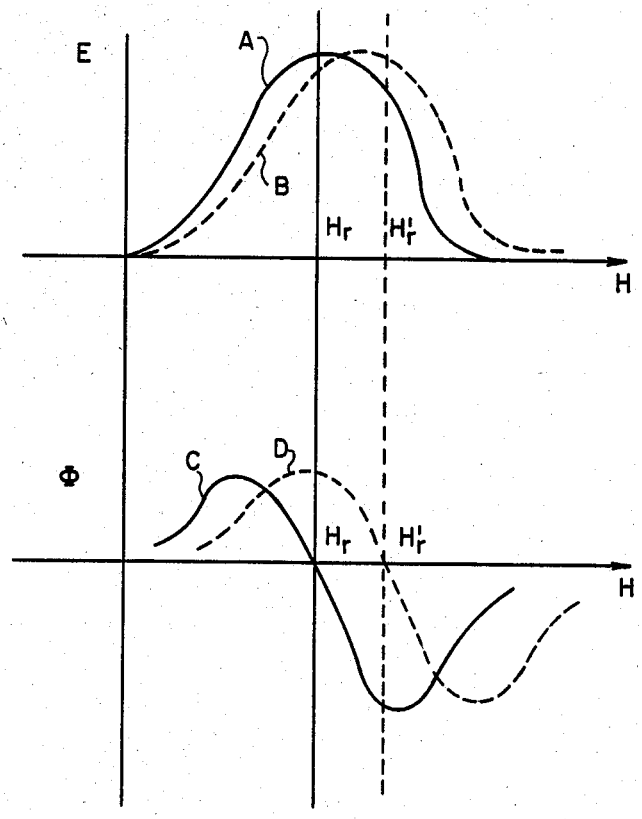
FIG. 1 is a graph of the energy absorbed as a function of magnetic field along with a graph of the corresponding phase shift.

Referring now to the drawings, wherein like reference numerals designate identical or corresponding parts throughout the several views, and more particularly to FIG. 1 thereof, there is shown a graph of the energy absorbed by a ferrite sample as a function of the magnetic field H and the corresponding phase $\phi$ as a function of H. Line A of FIG. 1 shows that the peak energy occurs at the external magnetic resonance field Hr'. Line C shows the corresponding $\phi$ for line A with a phase shift of zero occuring at Hr'. Line B shows the peak energy occurring at a different external magnetic resonance field Hr' because of a voltage being applied to a ferrite sample. Line D shows the corresponding for line B with a phase shift of zero occuring at Hr'. Lines B and D are representative of the fact that Hr' can be changed by changing the voltage on the ferrite sample.

This can better be explained by referring to the equation that determines Hc which is $$Hc=H-4\pi M-H_A$$

where, with respect to the sample, H is the external magnetic field, M is the saturation magnetization, $H_A$ is the anisotropy field and Hc is the value of H where magnetic resonance occurs. In the present invention H exists due to some external source, $H_A$ is determined in part by the voltage applied across the sample. The $H_c$ is fixed if the operating frequency is fixed as in ferromagnetic resonance. Since Hc is fixed, H is the only quantity that can vary to compensate for the variation affected on $H_A$ by the application of a D.C. voltage.

By controlling the variation of $H_A$ and consequently H, the phase shift of a reflected microwave signal can be modulated.

Only magnetic samples where $H_A$ can be varying by varying the voltage across the sample can be used in the present invention. This phenomenon where $H_A$ of a sample can be varied with a voltage across the sample is known as a magneto-electric effect. By changing the voltage across the magnetic material the switching speed can be accomplished rapidly, only limited by the relaxation time of the magnetic material. The relaxation times of ferrites can vary between $\frac{1}{3}$ msec to $10^{-10}$sec. Thus, switching or tuning speeds of 10 nanoseconds or better are feasible. This speed is as much as $10^4$ faster then heretofore known.

Some additional advantages to using a material that exhibits the magneto-electric effect, besides the advantage of fast switching times, are low power consumption, small size and temperature compensation. Since it requires less then 10 nanowatts of power to tune the ferromagnetic resonance by the electric field method, the power consumption for tuning is very low compared to tuning by a magnetic field such as that provided by e.g., a helmholtz coil.

In terms of size, tuning by the electric field method requires only one wire (the other electrode can be the waveguide itself) which can be very small in size and weight in comparison to a helmholtz coil.

Additionally, temperature compensation can be easily effected by tuning back (in a feedback sense) any changes in frequency induced by thermal changes using this electric technique of tuning.

One possible application of many possible applications of this invention is now described in the following embodiment.

Figure 2:
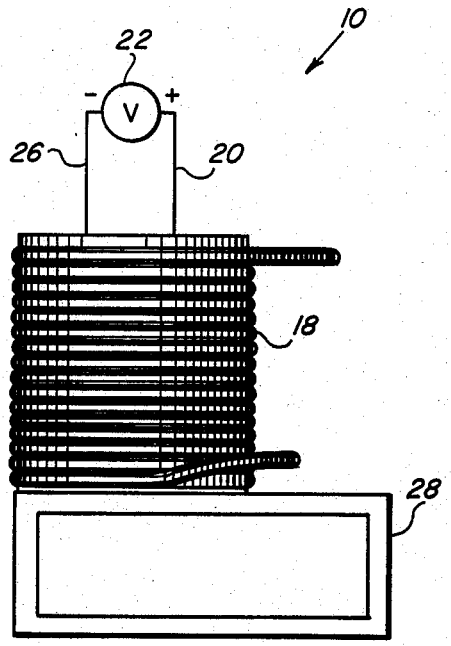
FIG. 2 is a schematic drawing of a tuneable microwave cavity.
Figure 3:
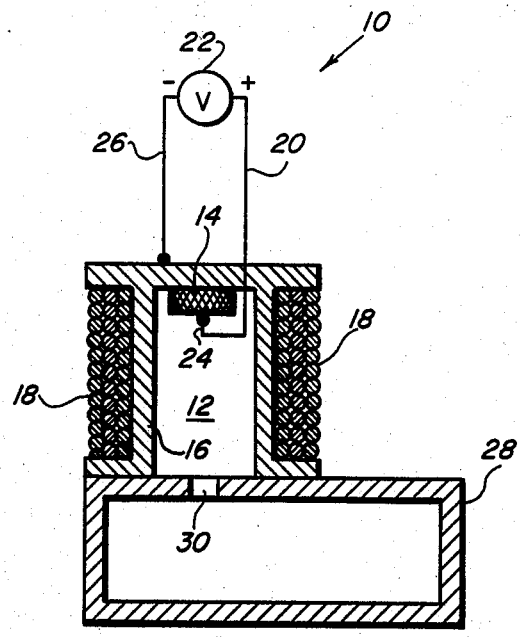
FIG. 3 is a cross-sectional schematic drawing of a tuneable microwave cavity.

A microwave cavity 10 shown in FIG. 2 is comprised of a cylindrical cavity 12 that is loaded with a lithium ferrite disc 14, for example. The cylindrical cavity 12 may be made out of a brass cylinder 16, for instance, having a circumferential flange at opposite ends thereof holding solenoid winding 18 in place. A voltage is applied to the ferrite disc 14 (maintained at 77 degrees kelvin) by attaching a positive lead 20 from a power source 22 to disc 14 at the disc's base 24. The negative lead 26 is attached to the cylinder 16. As shown, the power source can be, for example, a battery that produces a DC variable voltage from 0 to 150 volts. The microwave cavity 10 sits atop a waveguide 28 and is coupled to the waveguide through a coupling cross slot 30.

Ferrite disc 14 is prepared for use by providing both faces of ferrite disc 14 with thin electrodes (not shown) consisting of, for example, either silver paint or evaporated aluminum. The disc 14 is then enclosed, for instance, in a nylon holder (not shown) and fitted with fine wire, i.e., copper wire, through which a static voltage v could be applied.

In the operation of the invention the microwave magnetic field is parallel to the electrodes, whereas the static magnetic field H (about 6K0E of which may be provided by permanent magnet) and the (small) microwave electric field are both perpendicular to the electrodes on disc 14. The change of phase that is achieved is 0.1 degree per 100 volts applied across the disc 14.

The use of a material that exhibits the magneto-electric effect to change the magnetic resonance value H can be implanted in all situations where a changing external H field through a magnetic material currently is used to tune a microwave signal.

Since electrodes must be applied to any magneto-electric sample, the configuration of the sample should be planar. This lends itself to many device applications where planar geometry is required, such as: stripline devices, SAW devices and waveguides to name a few.

Obviously, numerous (additional) modifications and variations of the present invention are possible in light of the above teachings. It is therefore to be understood that within the scope of the appended claims, the invention may be practiced otherwise than as specifically described herein.

What is claimed and desired to be secured by Letters Patent of the United States is:

1. An apparatus for changing the phase of a microwave signal comprising:

a microwave cavity means for producing an axial magnetic field inside the microwave cavity;

a sample, having an anistropy field $H_a$, that exhibits the magneto-electric effect which allows for changes in the anistropy field $H_a$ of the sample in response to a voltage applied across the sample, said sample being loaded inside said cavity such that said sample is located in the magnetic field produced by said magnetic field producing means;

means for biasing said sample so a voltage difference will lies across said sample; and means for coupling the microwave signal to said cavity so that said sample in said cavity will absorb the microwave signal and then reemit the microwave signal with a phase shift through said coupling means, the phase shift of the reemitted microwave signal being determined by the voltage induced by the biasing means on the sample.

2. An apparatus for changing the phase of a microwave comprising:

a sample, having an anistropy field $H_a$, that exhibits the magneto-electric effect which allows for changes in the anistropy field $H_a$ of the sample in response to a voltage applied across the sample;

a microwave cavity loaded with said sample;

a voltage source;

a feed electrode and a ground electrode attached to said sample and to said voltage source so that a voltage difference is created across said sample by said voltage source, said feed electrode connecting said voltage source and said sample by passing through said microwave cavity;

a coupling slot in said microwave cavity that enables microwaves to enter into said microwave cavity and leave said microwave cavity after the microwave has been phase shifted;

and means for producing an axial magnetic field inside said microwave cavity.

3. An apparatus according to claim 2 wherein the magnetic sample is made of lithium ferrite.

4. An apparatus according to claim 3 wherein said voltage source provides a variable voltage to said sample.

5. An apparatus according to claim 3 wherein said microwave cavity is a brass cylinder.

6. An apparatus according to claim 5 wherein said brass cylinder has a circumferential flange at opposite ends.

7. An apparatus according to claim 3 wherein said magnetic field means is a solenoid winding wrapped around said microwave cavity.

8. An apparatus according to claim 3 wherein said magnetic field means is a horse-shoe magnet located around said microwave cavity.

9. An apparatus according to claim 6 wherein said magnetic field means is a solenoid winding wrapped around said brass cylinder.

10. An apparatus according to claim 6 wherein said magnetic field means is a horse-shoe magnet located around said brass cylinder.

11. An appartus according to claim 2 wherein the voltage difference created across said sample by said voltage source is between 0 and 500 volts.

12. An apparatus according to claim 9 wherein the voltage difference created across said sample by said voltage source is between 0 and 500 volts.

13. An apparatus according to claim 10 wherein the voltage difference created across said sample by said voltage source is between 0 and 500 volts.

14. A method for changing the phase of a microwave comprising:

transmitting a microwave signal into a waveguide;

introducing the microwave signal into a microwave cavity through a coupling slot that couples the microwave cavity and the waveguide;

generating the magneto-electric effect which allows for changes in the anistropy field $H_a$ in a sample of material disposed in said microwave cavity in order to shift the phase of said microwave signal in said microwave cavity in accordance therewith;

reintroducing the phase shifted microwave into the waveguide.

* * * * *